United States Patent [19]

Dillon

[11] 4,235,071

[45] Nov. 25, 1980

[54] YARN FALSE TWIST APPARATUS

[75] Inventor: Roy E. Dillon, Rockingham, N.C.

[73] Assignee: Barmag Barmer Maschinenfabrik Aktiengesellschaft, Remscheid, Fed. Rep. of Germany

[21] Appl. No.: 17,447

[22] Filed: Mar. 5, 1979

[51] Int. Cl.[3] ..... D01H 15/00; D02G 1/08

[52] U.S. Cl. ..... 57/280; 57/339

[58] Field of Search ..... 57/279, 280, 337, 338, 57/339, 340

[56] References Cited

U.S. PATENT DOCUMENTS

| | | | |
|---|---|---|---|
| 3,287,890 | 11/1966 | McIntosh et al. | 57/339 |
| 3,762,149 | 10/1973 | Raschle | 57/339 |
| 3,872,661 | 3/1975 | Eaves | 57/339 |
| 3,911,661 | 10/1975 | Naylor | 57/280 X |
| 3,942,313 | 3/1976 | Gassner et al. | 57/339 |
| 3,955,350 | 5/1976 | Schuster | 57/339 |
| 3,998,041 | 12/1976 | Graf et al. | 57/337 |
| 4,027,467 | 6/1977 | Smith | 57/337 X |
| 4,047,374 | 9/1977 | Venot | 57/338 |
| 4,059,948 | 11/1977 | Derail et al. | 57/280 |
| 4,149,366 | 4/1979 | Bass et al. | 57/280 |

*Primary Examiner*—John Petrakes

*Attorney, Agent, or Firm*—Bell, Seltzer, Park & Gibson

[57] ABSTRACT

A friction false twist apparatus is provided which may be readily threaded-up during operation, and which includes at least three spindles mounted for rotation about fixed axes, with each spindle mounting a plurality of circular discs, and with the discs overlapping at a central location between the spindles. The spindles are concurrently rotated by a common endless drive belt, and a movable yarn deflecting means is provided for selectively moving a yarn from an inoperative laterally spaced position where thread-up may be effected, to an operative path of travel disposed centrally between the spindles and wherein twist is imparted to the yarn by contact with the rotating discs. There is also provided a fixed yarn guide for guiding the yarn from the operative path of travel to a position exteriorly of the area encompassed by the endless drive belt, whereby thread-up may be effected without manually threading the yarn through either the overlapping discs or the endless belt.

17 Claims, 8 Drawing Figures

YARN FALSE TWIST APPARATUS

The present invention relates to a friction false twist apparatus having an improved thread-up capability.

In the processing of synthetic thermoplastic yarns, it is common to impart "false twist" to the yarn to improve its elasticity and bulk. Typically, such "false twist" is applied in a continuous process, wherein a moving yarn is subjected to simultaneous twisting, heat setting, cooling, and untwisting, and which results in the twist being permanently set into the yarn.

One present type of apparatus for imparting twist to a moving yarn includes a number of friction surfaces over which the thread is guided, note for example, the prior devices described in U.S. Pat. No. 3,813,868 to Lorenz. In one specific false twist apparatus as described in the referenced patent, three spindles are arranged for rotation about parallel axes which are positioned at the corners of an equilateral triangle. Each spindle mounts a plurality of circular friction discs, with the discs of the three spindles overlapping in plan view. The spindles are rotated in a common direction at high speed, and a moving yarn is guided along a path of travel centrally through the spindles, and such that the yarn engages the surfaces of the overlapping rotating discs and follows a zig-zag path of travel. Also, the contact with the rotating discs serves to impart either a right-hand or a left-hand twist to the yarn, depending upon the direction of rotation of the spindles.

While friction false twist devices of the described type function well in the actual twisting operation, difficulties are encountered in attempting to thread-up the devices while the spindles are operatively rotating. In this regard, it is conventional to mount a large number of friction twist devices on a common frame, and to drive a number of devices with a common drive belt. It is not feasible to stop operation during the thread-up procedure for one of the twist devices, and providing for belt engagement and disengagement of each device individually for thread-up purposes adds to the expense of the overall machine. Thus, it is highly desirable that the yarn be threaded through the overlapping discs while they are rotating at high speed.

To facilitate the thread-up procedure, it has been proposed to mount one of the spindles on a laterally pivotal axis, whereby the spindles may be initially laterally separated to facilitate entry of the yarn into its operative position between the spindles. Once the yarn is in position, the spindles may be closed. However, such a construction necessarily requires that two drive belts be employed for transferring the rotation to all of the spindles, and the presence of two drive belts creates an additional problem in that it is difficult to detect breakage of one of the belts, since the non-driven spindle will continue to rotate by reason of its contact with the moving yarn, but at a slower speed. As will be apparent, such non-uniform rotation of the spindles will result in the application of non-uniform twist to the yarn, which is unacceptable.

It has also been proposed to mount the spindles for rotation about fixed axes so that a single drive belt may be employed, and to provide a movable thread guide for assisting in inserting the yarn into its operative position between the discs of the spindles, note for example U.S. Pat. Nos. 3,942,313 and 3,955,350. However, in such prior devices, the yarn must be threaded through the area encompassed by the drive belt, which is an awkward and difficult procedure, particularly since the belt is normally moving at an extremely high speed.

It is accordingly an object of the present invention to provide a friction false twist apparatus having an improved and greatly facilitated thread-up capability.

It is a further object of the present invention to provide a friction false twist apparatus which includes a common drive belt, whereby all of the spindles are necessarily driven at the same speed.

It is a more particular object of the present invention to provide a friction false twist apparatus of the described type, and wherein thread-up may be readily accomplished while the spindles are rotating, and without the need to manually thread the yarn through the discs of the spindles, or through the area encompassed by the endless drive belt.

It is still another object of the present invention to provide a friction false twist apparatus which is adapted to apply either right or left-hand twist by simply reversing the direction of rotation and vertical arrangement of the discs, and without any structural modification to the yarn guiding means.

These and other objects and advantages of the present invention are achieved in the embodiment illustrated herein by the provision of a false twist apparatus which comprises at least three spindles mounted to a bed-plate for rotation about fixed parallel axes which are positioned at the corners of an equilateral polygon. Each spindle includes a plurality of circular discs, with the discs of the spindles overlapping in plan view. The spindles are rotated by an arrangement which includes a pulley mounted on each spindle, and with a common endless drive belt operatively contacting each pulley.

A movable yarn deflecting means is mounted to the bedplate for selectively moving a yarn from an inoperative thread-up position disposed laterally of the operative path of travel disposed centrally between the spindles, and toward such operative path of travel. In addition, there is provided a fixed yarn guide mounted to the bed-plate for guiding the moving yarn exteriorly of the area encompassed by the endless belt.

To effect thread-up with the apparatus of the present invention, the movable yarn deflecting means is initially moved to the inoperative position, where thread-up may be effected without the need to manually thread the yarn through the discs of the spindles, or through the area encompassed by the endless belt. Once thread-up is effected, the movable yarn deflecting means is moved toward the operative path of travel, which results in the yarn being moved to its operative, twisting position centrally between the discs.

Some of the objects having been stated, other objects will appear as the description proceeds, when taken in connection with the accompanying drawings in which FIG. 1 is a perspective view illustrating a friction false twist apparatus embodying the features of the present invention;

Figure 1:
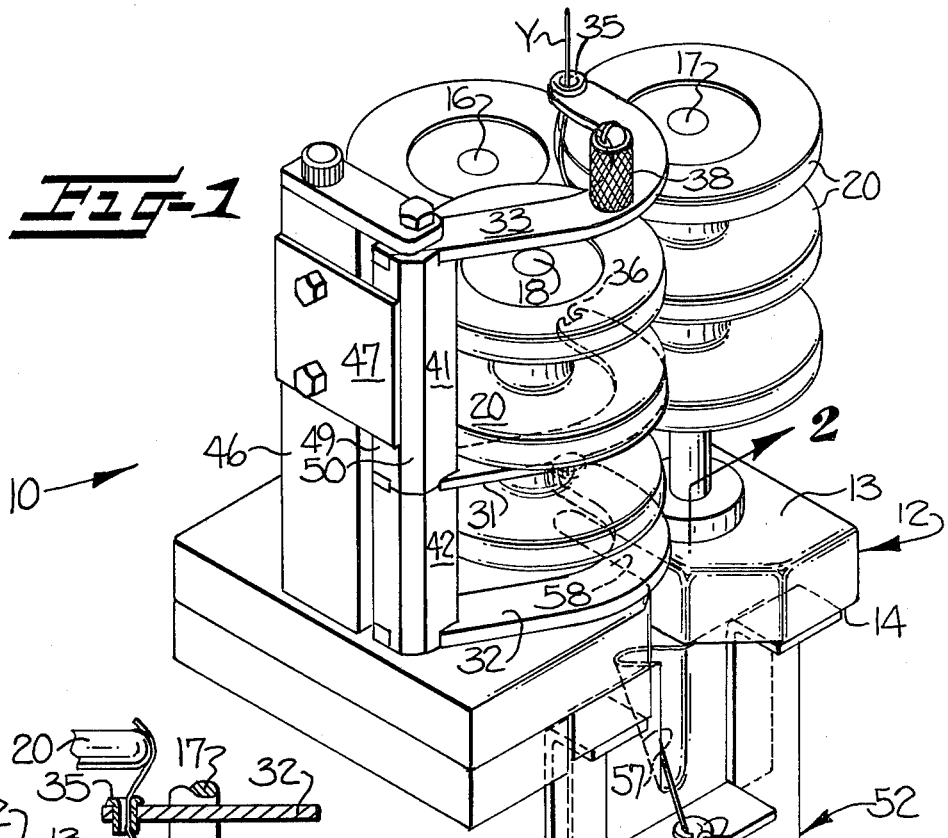

Referring more specifically to the drawings, a friction false twist apparatus embodying the features of the present invention is illustrated generally at 10. More particularly, the apparatus 10 comprises a mounting frame or bedplate 12, having an upper side 13 and an opposite lower side 14.

Three spindles 16, 17 and 18 extend through the bedplate and are mounted by suitable bearings (not shown) for rotation about fixed, parallel axes which are positioned at the corner points of an equilateral triangle. Each spindle fixedly mounts a plurality of circular discs 20 on the upper side of the bedplate, and with the discs of the spindles overlapping at a point centrally between the spindles, note FIG. 6, and defining an operative yarn path of travel extending axially therebetween in a generally zig-zag fashion.

Means are provided for concurrently rotating each spindle in a common direction, and which comprises a pulley 22 coaxially fixed to each spindle on the lower side of the bedplate, and a common endless drive belt 24 operatively contacting each pulley. In addition, a whorl 26 of relatively large diameter is coaxially fixed to the spindle 16, with the whorl 26 being adapted to be rotated by a moving drive belt (not shown) which is in tangential contact therewith. By this arrangement, rotation is transferred from the whorl 26 directly to the spindle 16, and to the other spindles 17 and 18 via the common drive belt 24.

Figure 7:
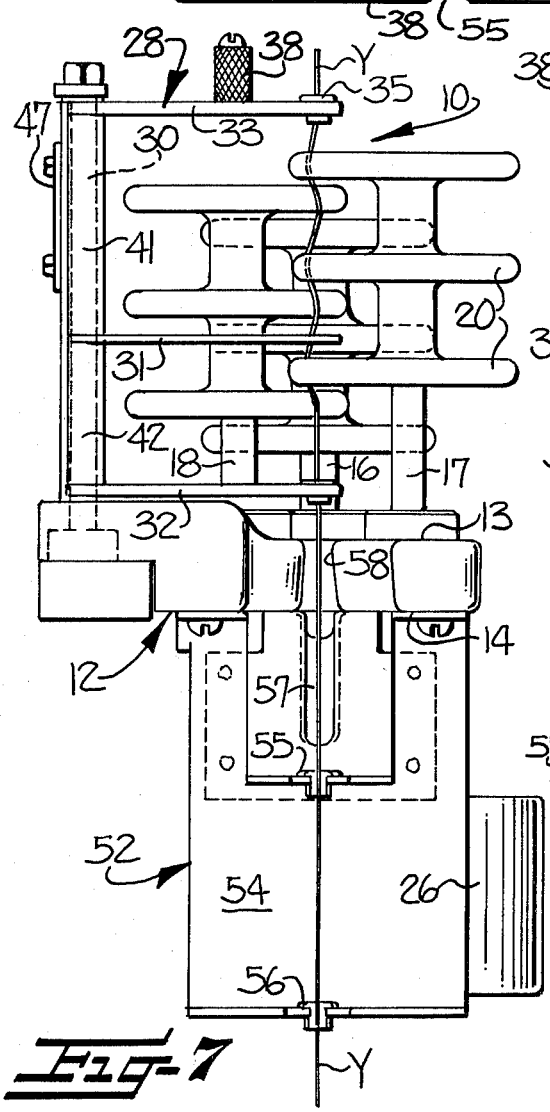
FIG. 7 is a front elevation view of the apparatus shown in FIG. 1.
Figure 8:
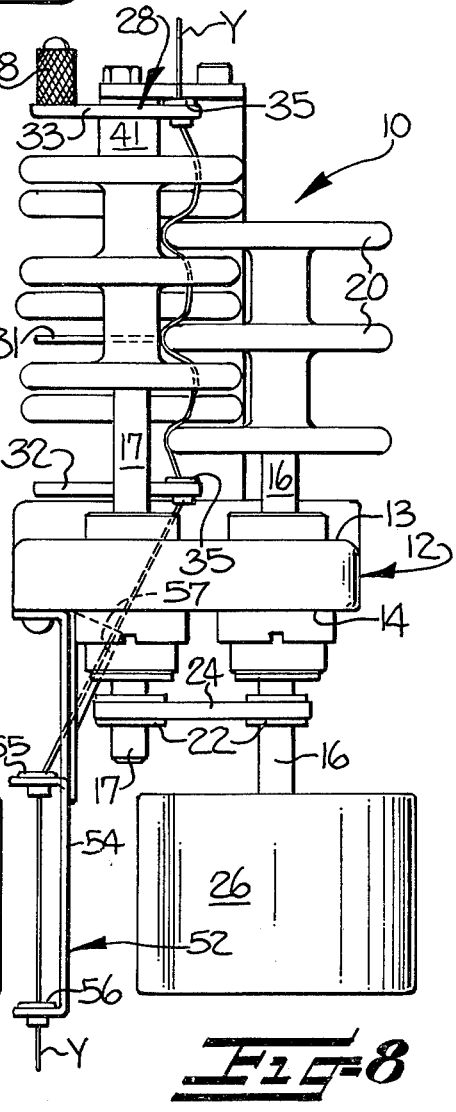
FIG. 8 is a side elevation view of the apparatus shown in FIG. 1.

To facilitate the thread-up of a yarn through the spindles, there is provided in the illustrated embodiment a movable yarn deflecting means 28 mounted on the upper side 13 of the bedplate for selectively moving a yarn Y from an inoperative thread-up position disposed laterally of the spindles and preferably free of contact with the discs (note FIG. 3), to the operative path of travel disposed centrally between the spindles and wherein twist is imparted to the yarn by contact with the rotating discs. More particularly, the movable yarn deflecting means 28 comprises a post 30 fixedly mounted on the upper side of the bedplate, with the post extending parallel to and adjacent the spindle 18. Three arcuately curved arms 31, 32, and 33 are rotatably mounted to the post 30 for concurrent movement in a plane perpendicular to the axes of the spindles. The first arm 31 is disposed intermediate the discs in the axial direction, and so as to move between the discs as best seen in FIG. 7. The second arm 32 is disposed between the discs and upper side 13 of the bedplate, and the third arm 33 is disposed axially beyond or above the free ends of the spindles and discs.

Figure 6:
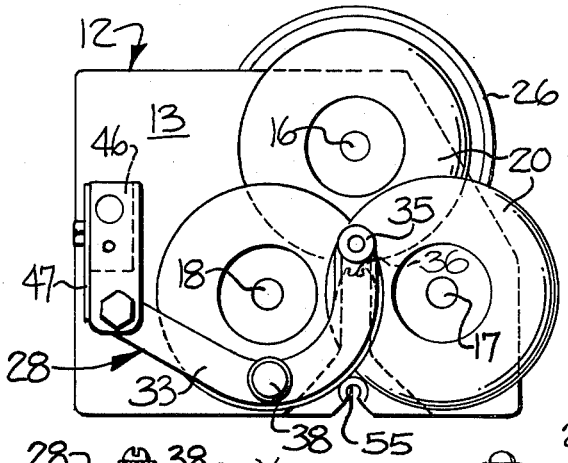
FIG. 6 is a top plan view of the apparatus shown in FIG. 1.

The second and third arms 32, 33 each include a yarn receiving means or eyelet 35 mounted adjacent the free end thereof, and the intermediate first arm includes a yarn receiving means or notch 36 at the end thereof. The two eyelets 35 are aligned in the direction of the spindle axes, but as best seen in FIG. 6, the notch 36 is spaced from the eyelets 35 in plan view. Also, the third arm includes a knob 38 to facilitate manual movement of the arms between inoperative and operative locations as further described below.

The arms 31–33 are concurrently pivotable about the axis of the post 30 by the structure described below, whereby the yarn Y may be selectively moved from the inoperative thread-up position toward the operative path of travel. During such pivotal movement, it will be noted that the two eyelets 35 and notch 36 move along an arc which extends between the inoperative position and operative path of travel. Also, it will be noted from FIG. 6 that during movement toward the operative path of travel, the eyelets 35 and notch 36 will pass through a point which is axially aligned with the cusp formed between the discs of the two adjacent spindles 17, 18. This results in the yarn being introduced directly into the cusp, rather than initially contacting one or the other of the sets of discs, and such direct introduction into the cusp is desirable in that it permits the apparatus to apply either right or left-hand twist to the yarn by simply reversing the direction of rotation, and vertical arrangement of the discs, and without the need for any structural modification of the yarn deflecting means 28. Stated in other words, if the yarn were to initially contact only one of the sets of discs upon movement toward the operative path of travel, the yarn would be carried toward the center of the spindles during one direction of spindle rotation, and away from the center in the other direction of spindle rotation. This latter situation would be unsatisfactory, since the discs would tend to move the yarn outwardly, and thus movement of the yarn into the center operative path of travel would be difficult if not impossible.

Figure 5:
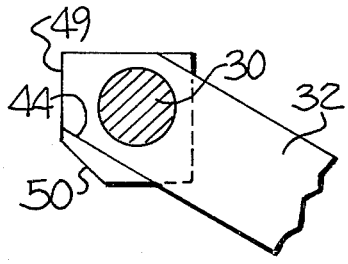
FIG. 5 is a sectional plan view taken substantially along the line 5—5 of FIG. 3.

Two sleeves 41, 42 are mounted coaxially about the post 30, and intermediate the three arms, to maintain the axial separation of the arms. Also, the sleeves 41, 42 include a transverse slot 44 (note FIG. 5) in each end for receiving the adjacent arm, and to thereby effect concurrent rotation of the three arms. Detent means is provided for selectively and releasably retaining the arms 31–33 in a first location corresponding to the inoperative thread-up position (note FIG. 3), and a second location wherein the eyelets 35 are aligned with the operative path of travel (note FIG. 1). At this latter location, it will be noted that the eyelets 35 then serve as guides for guiding the moving yarn into and from the operative path of travel between the discs. Also, since the notch 36 of the first arm is spaced from the eyelets 35 along the arc of movement, the notch 36 will be spaced rearwardly from the operative path of travel and free of contact with the moving yarn in the second location of the arms.

Figure 4:
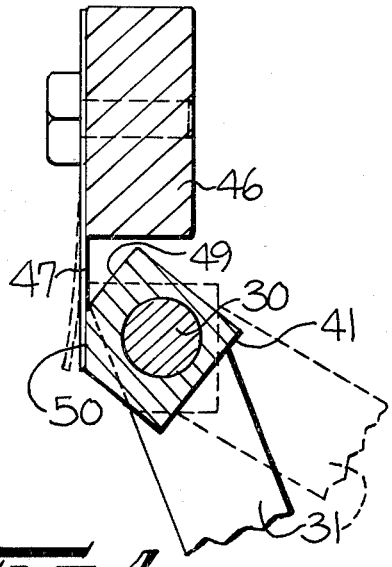
FIG. 4 is a sectional plan view taken substantially along the line 4—4 of FIG. 3.

The above-described detent means comprises a support block 46 fixedly mounted to the bedplate adjacent the post 30, and a thin plate 47 mounted on the block so as to be resiliently biased against the upper sleeve 41 on the post. The sleeve 41 includes a first flat side edge portion 49 adapted to be engaged by the plate 47 in the inoperative first location and so as to resist rotational movement, note the solid line position in FIG. 4. Similarly, the sleeve 41 includes a second flat side edge portion 50 which is adapted to be engaged by the plate in the operative second location, note the dashed line position in FIG. 4.

Figure 2:
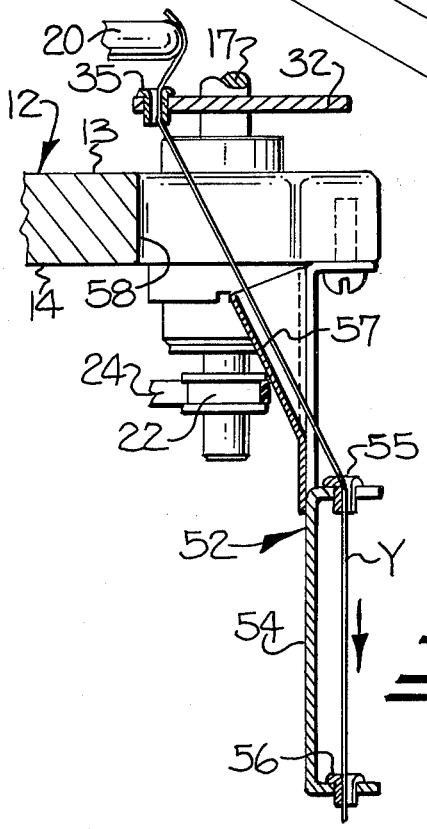
FIG. 2 is a sectional elevation view taken substantially along the line 2—2 of FIG. 1.
Figure 3:
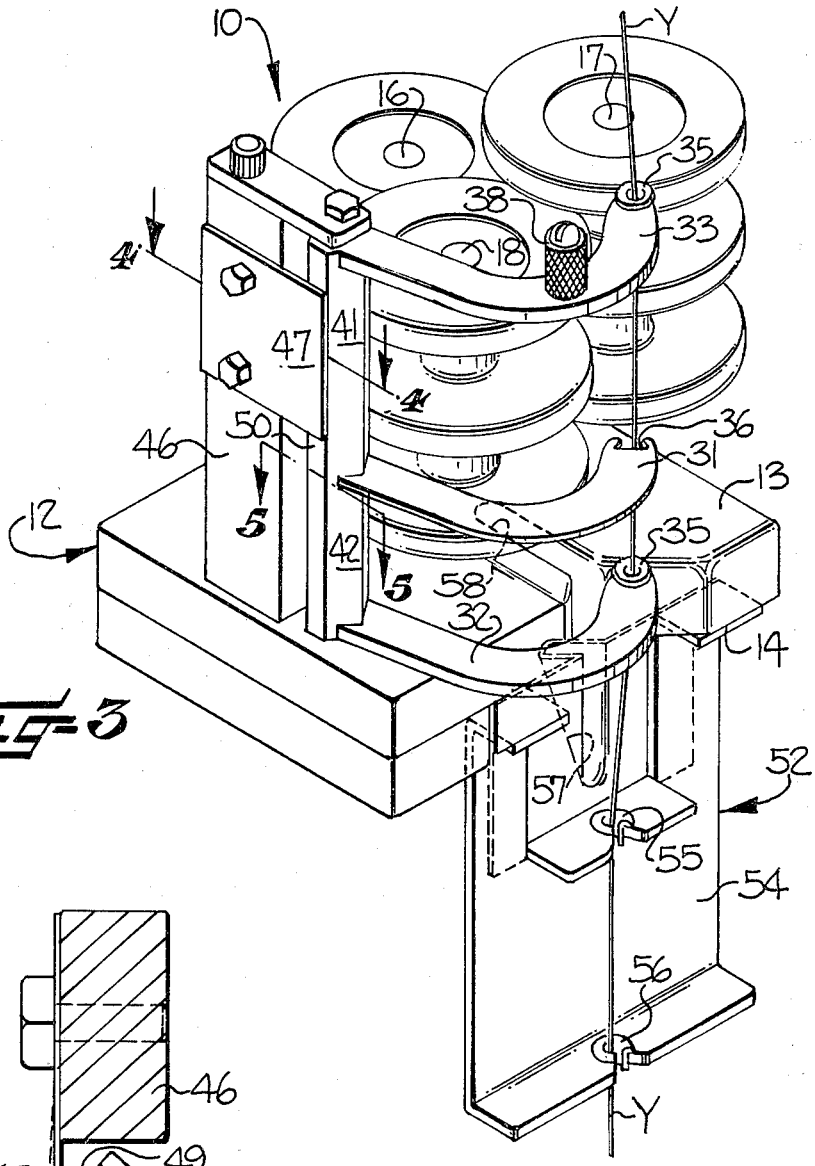
FIG. 3 is a view similar to FIG. 1, but with the yarn being held in its inoperative, thread-up position by the movable yarn guide member.

A fixed yarn guide means 52 is mounted on the lower side 14 of the bedplate and cooperates with the eyelet 35 of the second arm 32 of the movable yarn deflecting means 28 for guiding the yarn Y exteriorly of the area encompassed by the endless belt 24. This fixed yarn guide means 52 comprises a support plate 54 fixed to the bedplate 12, and which in turn mounts a first slotted eyelet 55 at a location exteriorly of the triangle defined by the three spindles 16–18 in plan view, and also exteriorly of the area encompassed by the endless belt 24. A second slotted eyelet 56 is positioned on the plate below the first eyelet 55, and as best seen in FIG. 3, the eyelets 55, 56 of the fixed yarn guide means are in substantial axial alignment with the yarn Y when guided in its inoperative position by the movable yarn deflecting means 28. The support plate 54 also includes an inclined channel portion 57 for accommodating the yarn in its operative position, note FIG. 2.

To permit passage of the yarn Y through the bedplate 12, there is provided an elongate slot 58 which communicates with the front edge of the bedplate adjacent the inoperative thread-up position of the yarn, to a point located centrally of the spindles 16–18. As will be apparent, the yarn is thereby able to freely pass through the bedplate 12 while in the inopertive thread-up position and upon movement to the operative path of travel. The channel portion 57 of the plate 54 is aligned with the slot 58 and is positioned intermediate the yarn and endless belt (note FIG. 2), to thereby prevent the yarn from contacting the adjacent drive belt and pulleys. Also, it will be seen that the yarn passes exteriorly of the area encompassed by the endless belt 24 during both thread-up, and the subsequent false twisting of the yarn.

In the drawings and specification, there has been set forth a preferred embodiment of the invention, and although specific terms are employed, they are used in a generic and descriptive sense only and not for purposes of limitation.

That which is claimed is:

1. An apparatus for friction false twisting a moving yarn, and characterized by the ability to readily permit thread-up while the apparatus is in operation, and comprising a mounting bedplate, at least three spindles mounted to said bedplate for rotation about fixed, parallel axes which are positioned at the corner points of an equilateral polygon having a number of sides corresponding to the number of spindles, each spindle including a plurality of circular discs mounted for rotation therewith, and with the discs of the spindles overlapping at a point centrally between said spindles and defining an operative path of travel extending axially therebetween, means for concurrently rotating each spindle in a common direction and such that twist is imparted to a yarn moving along said operative path of travel by contact with the rotating discs, and comprising a pulley coaxially fixed to each spindle, and a common endless drive belt operatively contacting each pulley, movable yarn deflecting means for selectively moving a yarn from an inoperative thread-up position disposed laterally of said operative path of travel, toward said operative path of travel, and comprising at least one arm, and means mounting each such arm to said bedplate for movement in a plane perpendicular to the axes of said spindles, and yarn guide means cooperating with the free end of the arm closest to said pulleys and for guiding the moving yarn between said operative path of travel and a position exteriorly of the area encompassed by said endless drive belt, whereby the thread-up of the yarn through the apparatus may be readily accomplished while the spindles are operatively rotating, and without the need to manually thread the yarn through the discs of the spindles, or through the area encompassed by the endless drive belt.

2. The apparatus as defined in claim 1 wherein said arm closest to said pulleys is disposed on the same side of all of said discs as said pulleys and includes a yarn receiving means at the free end thereof.

3. The apparatus as defined in claim 2 wherein said arm closest to said pulleys is mounted for movement such that said yarn receiving means moves along a path of movement which extends at least substantially between said inoperative position and said operative path of travel.

4. The apparatus as defined in claim 3 wherein said path of movement along which said yarn receiving means moves includes a point which is axially aligned with the cusp formed between the discs of two adjacent spindles, whereby the yarn is introduced directly into such cusp upon movement of the movable yarn deflection means from said inoperative position toward said operative path of travel.

5. The apparatus as defined in claim 4 wherein said movable yarn deflection means further comprises detent means for selectively and releasably retaining each of said arms in a first location adjacent said inoperative position and a second location adjacent said operative path of travel.

6. The apparatus as defined in claim 1 wherein there are three of said spindles, with said three spindles being positioned at the corner points of an equilateral triangle.

7. An apparatus for friction false twisting a moving yarn, and characterized by the ability to readily permit thread-up while the apparatus is in opertion, and comprising a mounting bedplate, at least three spindles mounted to said bedplate for rotation about fixed, parallel axes which are positioned at the corner points of an equilateral polygon having a number of sides corresponding to the number of spindles, each spindle fixedly mounting a plurality of circular discs and with the discs of the spindles overlapping at a point centrally between said spindles and defining an operative yarn path of travel extending axially therebetween, means for concurrently rotating each spindle in a common direction and such that twist is imparted to a yarn moving along said operative path of travel by contact with the rotating discs, and comprising a pulley coaxially fixed to each spindle at a location on one side of all of said discs, and a common endless drive belt operatively contacting each pulley, movable yarn deflecting means for selectively moving a yarn from an inoperative thread-up position disposed laterally of said operative path of travel, toward said operative path of travel, said yarn deflecting means comprising first and second arms, means mounting said arms on said bedplate in substantial axial alignment with each other and for concurrent movement in respective parallel planes which are perpendicular to the axes of said spindles, and with said first arm being disposed intermediate the uppermost and lowermost of said discs and said second arm being disposed on the same side of all of said discs as said pulleys, and yarn guide means and cooperating with the free end of said second arm of said movable yarn deflecting means for guiding the moving yarn between said operative path of travel and a position exteriorly of the area encompassed by the endless belt, whereby the thread-up of the yarn through the apparatus may be readily accomplished while the spindles are operatively rotating, and without the need to manually thread the yarn through the discs of the spindles, or through the area encompassed by the endless drive belt.

8. The apparatus as defined in claim 7 wherein said first and second arms are mounted to said bedplate for pivotal movement about an axis which is parallel to the rotational axes of said spindles.

9. The apparatus as defined in claim 7 wherein each of said first and second arms includes a yarn receiving means at the free end thereof, and wherein said two yarn receiving means move along a path of movement which extends at least substantially between said inoperative position and said operative path of travel upon movement of said arms.

10. The apparatus as defined in claim 9 wherein said path of movement along which said yarn receiving means of each of said first and second arms moves, includes a point which is axially aligned with the cusp formed between the discs of two adjacent spindles, whereby the yarn is introduced directly into such cusp upon movement of the movable yarn deflection means from said inoperative position toward said operative path of travel.

11. The apparatus as defined in claim 10 wherein said yarn receiving means of said first arm is spaced from said yarn receiving means of said second arm along said path of movement, and such that said arms may be moved to an operative location wherein said second arm yarn receiving means is axially aligned with said operative yarn path of travel and said first arm yarn receiving means is spaced rearwardly therefrom and is free of contact with the moving yarn.

12. The apparatus as defined in claim 11 wherein said yarn deflecting means further comprises a third arm mounted on said bedplate in substantial axial alignment with said first and second arms and for concurrent movement in a plane parallel to the planes defined by said first and second arms, said third arm being disposed axially on the side of said discs opposite said second arm and including a yarn receiving means at the free end thereof which is axially aligned with said yarn receiving means of said second arm.

13. The apparatus as defined in claim 7 wherein said bedplate includes opposite sides, wherein said spindles extend through said bedplate, with said discs being positioned on one side of said bedplate and said pulleys and drive belt being positioned on the other side of said bedplate, and wherein said yarn guide means is mounted on said other side of said bedplate.

14. The apparatus as defined in claim 13 further comprising elongate aperture means disposed through said bedplate for permitting the yarn to freely pass through said bedplate while in said thread-up position and upon movement to said operative path of travel.

15. The apparatus as defined in claim 14 wherein said elongate aperture means comprises a slot communicating with one edge of said bedplate and extending in a direction which corresponds to the direction of yarn movement when the yarn is moved from said inoperative position toward said operative path of travel.

16. The apparatus as defined in claim 15 wherein said yarn guide means comprises an eyelet positioned in substantial alignment with the yarn in its inoperative position.

17. The apparatus as defined in claim 16 wherein said yarn guide means further comprises a plate having a channel shaped portion which is aligned with said slot and positioned intermediate the moving yarn and endless belt, to thereby prevent the yarn from contacting the endless belt and pulleys.

* * * * *

UNITED STATES PATENT AND TRADEMARK OFFICE

CERTIFICATE OF CORRECTION

PATENT NO. : 4,235,071

DATED : November 25, 1980

INVENTOR(S) : Roy E. Dillon

It is certified that error appears in the above-identified patent and that said Letters Patent are hereby corrected as shown below:

On the title page, No. 75, "Roy E. Dillon, Rockingham, N.C." should be --Roy E. Dillon, Stoneville, N. C.--

Column 6, Line 30, "opertion" should be --operation--; same column, Line 64, delete "and"

Signed and Sealed this

*Third* Day of *March 1981*

[SEAL]

*Attest:*

RENE D. TEGTMEYER

*Attesting Officer*

*Acting Commissioner of Patents and Trademarks*